US005089379A

United States Patent [19]

Yatsuyanagi

[11] Patent Number: 5,089,379

[45] Date of Patent: Feb. 18, 1992

[54] IMAGE FORMING METHOD

[75] Inventor: Naoko Yatsuyanagi, Hino, Japan

[73] Assignee: Konica Corporation, Tokyo, Japan

[21] Appl. No.: 509,968

[22] Filed: Apr. 16, 1990

[30] Foreign Application Priority Data

Apr. 25, 1989 [JP] Japan ..... 1-106277

[51] Int. Cl.[5] ..... G03C 5/26; G03C 1/035

[52] U.S. Cl. ..... 430/434; 430/567; 430/587; 430/633; 430/963

[58] Field of Search ..... 430/567, 587, 633, 963, 430/434

[56] References Cited

U.S. PATENT DOCUMENTS

| | | | |
|---|---|---|---|
| 4,753,868 | 6/1988 | Goda et al. | 430/393 |
| 4,769,316 | 9/1988 | Miyasaki et al. | 430/570 |
| 4,791,053 | 12/1988 | Ogawa | 430/581 |
| 4,861,702 | 8/1989 | Suzuki et al. | 430/564 |
| 4,914,002 | 4/1990 | Inoue et al. | 430/264 |

*Primary Examiner*—Charles L. Bowers, Jr.

*Assistant Examiner*—Janet C. Baxter

*Attorney, Agent, or Firm*—Frishauf, Holtz, Goodman & Woodward

[57] ABSTRACT

An image forming method for a light-sensitive silver halide photographic material that provides a superior silver image in a short time is disclosed. The image forming method comprises the steps of subjecting to imagewise exposure of said light-sensitive silver halide photographic material which comprises a support and a silver halide emulsion layer provided on said support, wherein said silver halide emulsion layer contains a silver halide grain having a crystal surface with an area ratio of (100) face to (111) face of not less than 5 and being spectrally sensitized in the wavelength range of 600 nm or more with a specific sensitizing dye; and at least one layer included in said light-sensitive silver halide photographic material contains a fluorine-containing surface active agents; and processing said exposed light-sensitive silver halide photographic material for a period of time of from 20 seconds to 60 seconds in total.

11 Claims, No Drawings

IMAGE FORMING METHOD

FIELD OF THE INVENTION

The present invention relates to a light-sensitive silver halide photographic material, and more particularly relates to an image forming method for a light-sensitive silver halide photographic material, that can form an image by rapid processing in a high sensitivity and without causing any processing non-uniformity.

BACKGROUND OF THE INVENTION

A method is known in which a radiation image used for medical diagnosis is converted into digital data, the data are image-processed utilizing a computer so as to be more suitable for diagnosis, and the image is reproduced by exposure to laser beams.

For the laser beams, lasers such as semiconductor lasers or helium-cadmium layers are commonly used as light sources of such a scanner-type recording apparatus.

Of these, the semiconductor lasers have many advantages such that they are compact in size and inexpensive, and yet can be readily modulated and have a long lifetime.

On the other hand, it is necessary for light-sensitive silver halide photographic materials adapted thereto, used for laser scanners, (hereinafter "light-sensitive materials for laser scanners") to be spectrally sensitized to regions of from the red region to the infrared region, having wavelengths of 600 nm or more, and cyanine dyes are commonly used.

In recent years, achievement of rapid processing of light-sensitive materials has made great strides, and the light-sensitive materials for laser scanners are also no exception thereto. That is to say, there is a strong demanded for making the development processing time shorter for the reason that it is desired to catch image information more rapidly.

Achievement of rapid processing of such light-sensitive materials, however, is not necessarily so simple as in the case of other light-sensitive silver halide photographic materials, because such light-sensitive materials for laser scanners have difficulties peculiar to themselves. Namely, development non-uniformity tends to be caused in the resulting image after development. This is presumably because a latent image formed as a result of exposure to a high-intensity light for a short time using the laser beams tends to be influenced by the changes in development conditions such as processing time, processing temperature, and stirring. In particular, the development temperature dependence is remarkable.

In relation to methods of preventing such development non-uniformity, a method in which a specific surface active agent is used is known, which is an attempt as disclosed, for example, in Japanese Patent Publication Open to Public Inspection (hereinafter referred to as Japanese Patent O.P.I. Publication) No. 29835/1989 or No. 148257/1988.

However, as the development processing is made more rapid, such conventional techniques can not be said to be satisfactory. For example, when the development time is within several ten seconds, a photosensitive layer in a developing solution may become very susceptible to the diffusion phenomenon that the concentration of a developing solution in a film shifts from a low-density image region to a high-density image region and finally becomes uniform over the whole region. In particular, the development temperature has a great influence in view of the fact that it governs the degree of swell of a film.

As another problem, from the view point of photographic performance, the above techniques have been involved in the problem that the maximum density can be obtained with difficulty, the resulting silver image has a yellowish tone as a result, and a tone of neutral gray, which is advantageous for the evaluation of an image, can not be obtained.

SUMMARY OF THE INVENTION

Accordingly, a first object of the present invention is to provide an image forming method for a light-sensitive silver halide photographic material, that can give a superior maximum photographic density and may cause no development non-uniformity or development staining.

A second object of the present invention is to provide an image forming method for a light-sensitive silver halide photographic material, that can obtain a silver image of neutral gray in the tone of an image after development.

A third object of the present invention is to provide an image forming method that can obtain the above performances by rapidly processing a light-sensitive silver halide photographic material spectrally sensitized to 600 nm or more.

Other and additional objects of the present invention will become apparent from the following descriptions.

As a result of intensive studies, the present inventors have found that these objects can be achieved by the following, and thus accomplished the present invention.

Namely, the above objects can be achieved by an image forming method comprising the steps of subjecting to imagewise exposure a light-sensitive silver halide photographic material which comprises a support and a silver halide emulsion layer provided on said support, wherein said silver halide emulsion layer contains a silver halide grain having an area ratio of (100) face to (111) face of not less than 5 and being spectrally sensitized with a sensitizing dye represented by the following Formula (I); and at least one layer included in said light-sensitive silver halide photographic material contains a fluorine-containing surface active agent; and processing said exposed light-sensitive silver halide photographic material with processes comprising developing with a developing solution, for a period of time of from 20 seconds to 60 seconds in total.

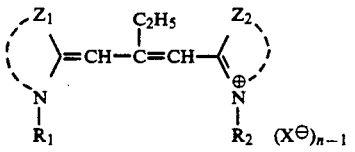

Formula (I)

wherein $Z_1$ and $Z_2$ each represent a group of non-metallic atoms necessary to complete a benzothiazole nucleus, benzoselenazole nucleus, naphthothiazole nucleus or naphthoselenazole nucleus that may have a substituent; $R_1$ and $R_2$ each represent a lower alkyl group, or a substituted lower alkyl group; $X^{\ominus}$ represents an anion; and n represents an integer of 1 or 2, provided that n is 1 when an intramolecular salt is formed.

DETAILED DESCRIPTION OF THE INVENTION

The present invention will be described below in detail.

The silver halide photographic emulsion grains of the present invention comprise a grain having a crystal surface with an area ratio of (100) face to (111) face of not less than 5. Various methods are known for preparing such grains. A commonly available method is a method in which an aqueous silver nitrate solution and an aqueous alkali halide solution are mixed by the controlled double-jet method while keeping the pAg value to a given value of not more than 8.10. A more preferred pAg value is not more than 7.80, and more preferably not more than 7.60.

There are not particular limitations on the pAg value at the time of the nucleation of silver halide grains. Mixing may also be carried out under conditions as in any methods well known by those skilled in the art.

The silver halide emulsion of the present invention may contain silver halide grains comprising a grain having an area ratio of (100) face to (111) face of not less than 5, and preferably not less than 10, preferably in an amount of not less than 50 wt. %, more preferably not less than 60 wt. %, and particularly not less than 80 wt. %.

The faces of a silver halide grain can be measured by Kubelka-Munk's dye adsorption method. In this method, used is a dye that is preferentially adsorbed on either the (100) face or the (111) face, and gives a different state of aggregation, depending on the face. The area ratio of (100) face to (111) face can be determined by spectrometry after the dye is adsorbed in varied amounts for its addition.

In regard to the face ratio of the surface of a silver halide grain, reference can be made on the method as disclosed in Journal of Chemical Society of Japan, 6, 942–946 (1984).

The sensitizing dye of the present invention, represented by Formula (I), will be described below.

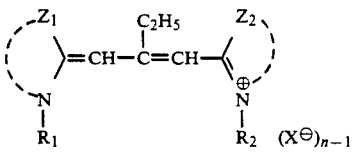

Formula (I)

In the formula, $Z_1$ and $Z_2$ each represent a group of non-metallic atoms necessary to complete a benzothiazole nucleus, benzoselenazole nucleus, naphthothiazole nucleus or naphthoselenazole nucleus that may have a substituent or no substituent. The benzothiazole nucleus includes, for example, benzothiazole, 5-chlorobenzothiazole, 5-methylbenzothiazole, 5-methoxybenzothiazole, 5-hydroxybenzothiazole, 5-hydroxy-6-methylbenzothiazole, 5,6dimethylbenzothiazole, 5-ethoxy-6-methylbenzothiazole, 5-phenylbenzothiazole, 5-carboxybenzothiazole, 5-ethoxycarbonylbenzothiazole, 5-dimethylaminobenzothiazole, and 5-acetylaminobenzothiazole. The benzoselenazole nucleus includes, for example, benzoselenazole, 5-chlorobenzoselenazole, 5-methylbenzoselenazole, 5-methoxybenzoselenazole, 5-hydroxybenzoselenazole, 5,6-dimethylbenzoselenazole, 5,6-dimethoxybenzoselenazole, 5-ethoxy-6-methylbenzoselenazole, 5-hydroxy-6-methylbenzoselenazole, and 5-phenylbenzoselenazole. The naphthothiazole nucleus includes, for example, β-naphthothiazole, and β,β-naphthothiazole. The naphthoselenazole nucleus includes, for example, β-naphthoselenazole. $R_1$ and $R_2$ each represent a lower alkyl group, or a substituted lower alkyl group, as exemplified by a methyl group, an ethyl group, a n-propyl group, a β-hydroxyethyl group, a β-carboxyethyl group, a γ-carboxypropyl group, a γ-sulfopropyl group, a γ-sulfobutyl group, a δ-sulfobutyl group, and a sulfoethoxyethyl group.

$X^{\ominus}$ represents an anion, as exemplified by a halide ion, a perchlorate ion, a thiocyanate ion, a benzenesulfonate ion, a p-toluenesulfonate ion, a methylsulfonate ion. The letter symbol n represents a positive integer of 1 or 2, provided that n is 1 when an intramolecular salt is formed.

The sensitizing dye of the present invention belongs to thia- or selenacarbocyanaines wherein an ethyl group is substituted on the meso position on a trimethine chain, and has a sensitizing ability advantageous to the spectral sensitization in a particular wavelength region.

For the purpose of exemplification, typical examples of the sensitizing dye of the present invention are shown below. The present invention, however, is by no means limited to these only.

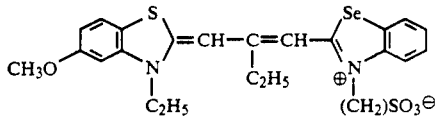

(1)

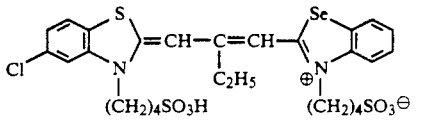

(2)

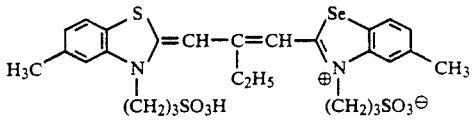

(3)

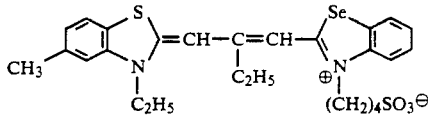

(4)

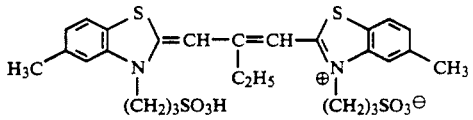

(5)

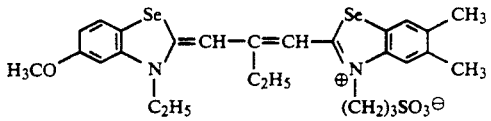

(6)

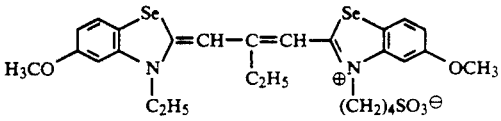

(7)

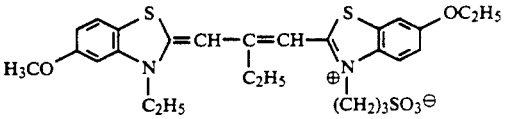

(8)

-continued
(9)
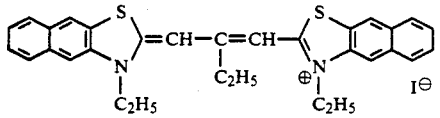
(10)
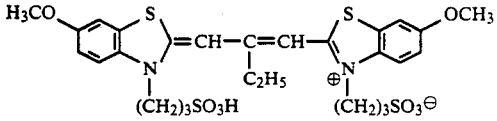
(11)
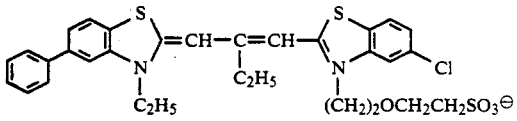
(12)
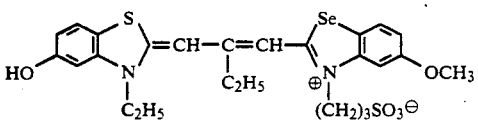
(13)
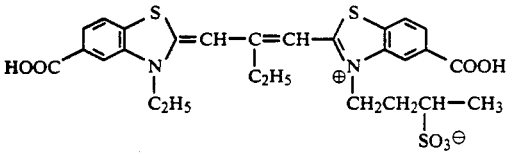
(14)
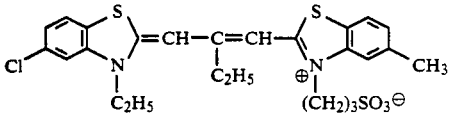
(15)
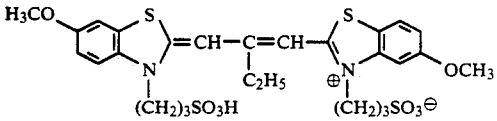
(16)
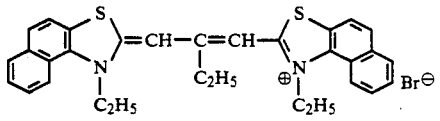
(17)
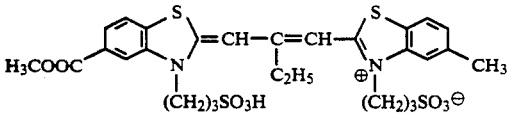
(18)
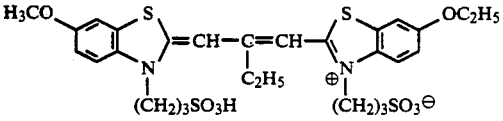
(19)
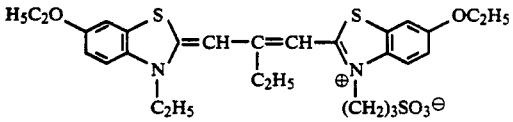
(20)
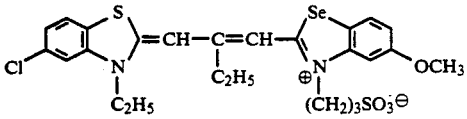
-continued
(21)
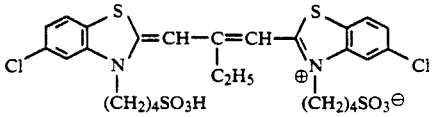
(22)
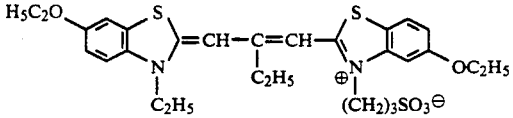
(23)
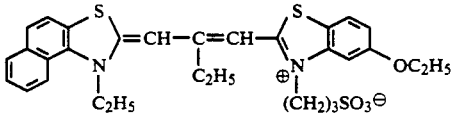
(24)
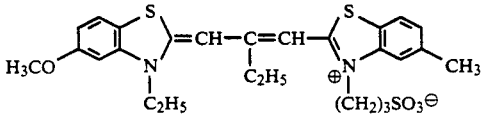
(25)
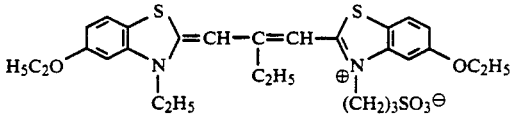
(26)
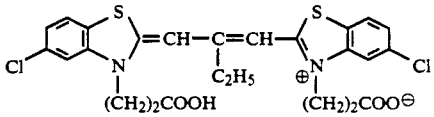
(27)
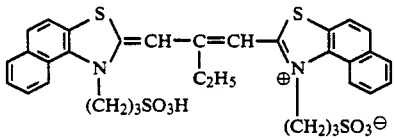
(28)
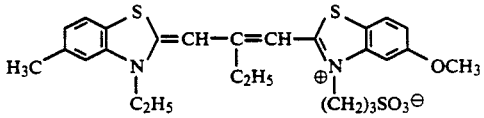
(29)
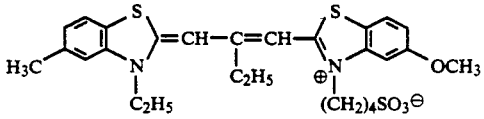
(30)
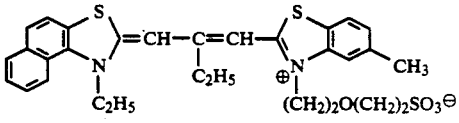
(31)
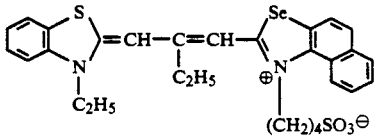

-continued (32)

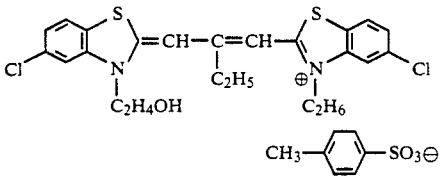

These sensitizing dyes according to the present invention can be readily obtained by the synthesis methods as disclosed in British Patent No. 660,408, U.S. Pat. No. 3,149,105, etc.

The above dyes according to the present invention may be directly dispersed in an emulsion. Alternatively, these dyes may also be first dissolved in a suitable solvent as exemplified by methyl alcohol, ethyl alcohol, methyl cellosolve, acetone, water, pyridine, or a mixed solvent of any of these to form a solution, which is then added in the emulsion.

The amount of the sensitizing dye according to the present invention, added in the silver halide emulsion, is not uniform and depends on the type of silver halide or the silver halide content. The dye, however, may preferably be added in an amount of from 0.005 to 1.0 g, and more preferably from 0.01 to 0.6 g, per mol of silver halide.

These sensitizing dyes are added alone or in combination in the silver halide emulsion according to the method of the present invention so that the desired spectral sensitivity can be obtained.

The above sensitizing dye according to the present invention may be added at any time of from before completion of a desalting step to immediately before completion of chemical ripening. It may preferably be added at the step of chemical ripening, and particularly preferably at the time the chemical ripening is started.

The desalting may be carried out by any methods employed in the present industrial field. For example, it may be carried out by the coagulation process or the noodle washing process, as disclosed in Research Disclosure No. 17643, page 23, 1978.

Next, the fluorine-containing surface active agent added and contained in at least one layer of the light-sensitive silver halide photographic material of the present invention includes nonionic, anionic or cationic surface active agents or those having a betaine structure. It may preferably have a fluoroalkyl group having 4 or more carbon atoms.

The anionic surface active agents include, for example, those having a group such as sulfonic acid or a salt thereof, carboxylic acid or a salt thereof, or phosphoric acid or a salt thereof; the cationic or betaine-type surface active agents, those having a group such as an amine salt, an ammonium salt, a sulfonium salt, a phosphonium salt, or an aromatic amine salt; and also the nonionic surface active agents, those having a polyalkylene oxide group, a polyglyceryl group, or the like.

These fluorine-containing surface active agents include the compounds as disclosed in U.S. Pat. No. 4,335,201 and No. 4,347,308, British Patents No. 1,417,915 and No. 1,439,402, Japanese Examined Patent Publications No. 26687/1977, No. 26719/1982 and No. 38573/1984, Japanese Patent O.P.I. Publications No. 149938/1980, No. 48520/1979, No. 14224/1979, No. 200235/1983, No. 146248/1982 and No. 196544/1983, etc.

Preferred examples of these compounds are shown below, to which, however, the present invention is by no means limited.

$C_8F_{17}SO_3K$ F-1

$C_7F_{15}COONa$ F-2

$C_8F_{17}CH_2CH_2OSO_3Na$ F-3

$C_8F_{17}SO_2N(C_3H_7)-CH_2COOK$ F-4

F-5

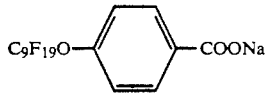

F-6

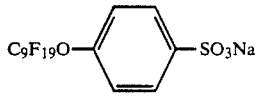

$C_8F_{17}SO_2N(C_3H_7)(CH_2CH_2O)_4(CH_2)_4SO_3Na$ F-7

$C_8F_{17}SO_2N(C_3H_7)CH_2CH_2O-P(=O)(ONa)-ONa$ F-8

$C_{10}F_{21}COOCH_2CH(OH)CH_2SO_3Na$ F-9

$H(CF_2)_6CH_2OOC-CH_2$
$H(CF_2)_6CH_2OOC-CH(SO_3Na)-$ F-10

$C_8F_{17}CH_2CH_2OOC-CH_2$
$C_4H_9OOC-CH(SO_3Na)-$ F-11

$C_8F_{17}SO_2N(H)CH_2CH_2\overset{\oplus}{N}(CH_3)_2-CH_2COO^{\ominus}$ F-12

$C_8F_{17}SO_2N(H)CH_2CH_2CH_2OCH_2CH_2\overset{\oplus}{N}(CH_3)_2-CH_2COO^{\ominus}$ F-13

$C_8F_{17}SO_2N(H)CH_2CH_2CH_2OCH_2CH_2\overset{\oplus}{N}(CH_3)_2-CH_2CH_2COO^{\ominus}$ F-14

$C_7F_{15}CON(H)CH_2CH_2\overset{\oplus}{N}(CH_3)_2-CH_2COO^{\ominus}$ F-15

$H(CF_2)_{10}CON(CH_3)CH_2CH_2\overset{\oplus}{N}(CH_3)(CH)-CH_2COO^{\ominus}$ F-16

$C_8F_{17}SO_2N(H)CH_2CH_2\overset{\oplus}{N}(CH_3)_2-CH_2CH_2SO_3^{\ominus}$ F-17

-continued

F-18

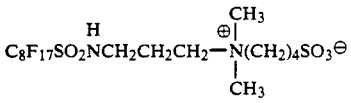

F-19

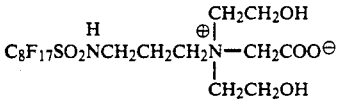

F-20

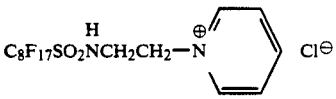

F-21

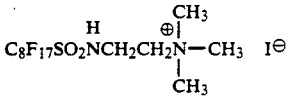

F-22

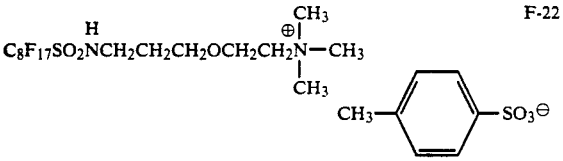

F-23

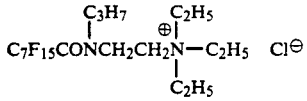

F-24

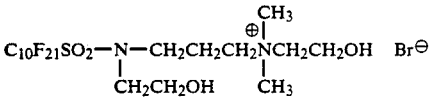

F-25

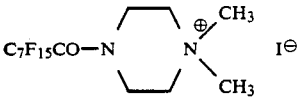

F-26

$C_7F_{15}COO(CH_2CH_2O)_{10}H$

F-27

$C_{10}F_{21}COO(CH_2CH_2O)_{10}H$

F-28

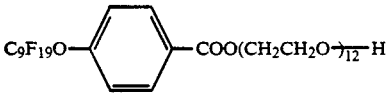

F-29

$C_8F_{17}SO_2N(CH_3)(CH_2CH_2O)_9H$

F-30

$C_8F_{17}SO_2N(C_{10}H_{21})(CH_2CH_2O)_{12}H$

F-31

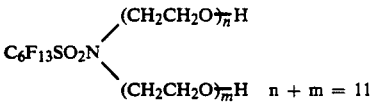

F-32

$C_8F_{17}SO_2N(C_3H_7)(CH_2CH_2O)_{15}H$

F-33

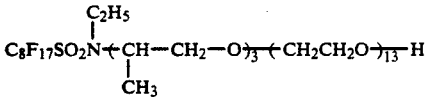

-continued

F-34

$C_8F_{17}CH_2CH_2O(CH_2CH_2O)_{12}H$

F-35

$C_8F_{17}SO_2N(C_3H_7)-CH_2COO(CH_2CH_2O)_9H$

F-36

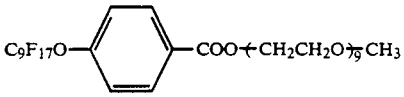

F-37

$C_9F_{19}O(CH_2CH_2O)_9CH_3$

F-38

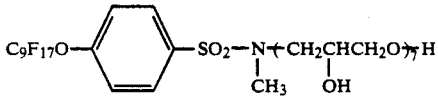

F-39

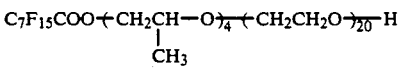

The above fluorine-containing surface active agents according to the present invention may be added in any of the component layers of the light-sensitive silver halide photographic material. For example, they are added in a non-light-sensitive layer such as a surface-protective layer, an intermediate layer, a subbing layer or a backing layer, or in a silver halide emulsion layer.

They may more preferably be added in an emulsion layer and its surface-protective layer, and a subbing layer and its surface-protective layer. They may be not only used in a layer on one side, but also simultaneously used in layers on both sides.

The fluorine-containing surface active agents according to the present invention may be used in combination of two or more kinds, or may be used in combination with other synthetic surface active agents.

The above compound may be added in an amount, though variable depending on the type of the compound, of from 0.0001 to 2 g, and preferably from 0.001 to 0.5, per 1 $m^2$ of the silver halide emulsion layer of the light-sensitive silver halide photographic material according to the present invention.

When the compound is added in a hydrophilic colloid layer other than the silver halide emulsion layer, it may be in an amount of from 0.0001 to 2 g, and preferably from 0.001 to 0.5 g, thereby satisfactorily bringing about the effect as aimed in the present invention.

The silver halide emulsion used in the present invention will be described below.

The silver halide grains contained in the light-sensitive silver halide photographic material of the present invention are comprised of a silver halide containing silver iodide, which may be any of silver iodochloride, silver iodobromide and silver chloroiodobromide. In particular, it may preferably be silver iodobromide in view of the advantage that grains with a high sensitivity can be obtained.

The silver iodide contained in such silver halide grains may be in an amount of from 0.05 to 10 mol %, and preferably from 0.5 to 8 mol %, on the average. In the inner part of the grain, a localized part is present in which the silver iodide has localized in a content of not less than 20 mol %.

In such an instance, the silver iodide-localized part of the grain may preferably be present at the part as inner as possible from the outer surface of the grain, and it is particularly preferable for the localized part to be present 0.01 μm or more distant from the outer surface.

In the inner part of the grain, the localized part may be present in the form of a layer. Alternatively, it may have so-called core/shell structure, in which the core may form the localized part. In this instance, part or the whole of a core of the grain, excluding a shell with a thickness of 0.01 μm or more from the outer surface, may preferably be the localized part in which the silver iodide has localized in a content of not less than 20 mol %.

The silver iodide in the localized part may preferably be in a content of from 30 to 40 mol %.

The outer side of such a localized part is covered with a silver halide containing no silver iodide. More specifically, in a preferred embodiment, a shell with a thickness of 0.01 μm or more, particularly from 0.01 to 1.5 μm, from the outer surface is formed of a silver halide containing no silver iodide (silver bromide, in usual instances).

In the present invention, a method by which the localized area in which the silver iodide has localized in a high content of not less than 20 mol % is formed in the inner part (preferably at an inner side of the grain, 0.01 μm or more distant from the outer wall of the grain) may be a method in which no seed crystal is used.

In the instance where no seed crystal is used, no silver halide grain that may serve as a growth nucleus before start of ripening is present in a reaction mixture phase containing a protective-colloidal gelatin (hereinafter referred to as "mother liquor"), and hence a silver salt solution and a halide solution containing an iodide in a high concentration of 20 mol % or more are first fed to form the nucleus. Then, the feeding thereof is continued to make the grain to grow. As a final step, a shell layer having a thickness of 0.01 μm or more is formed with a silver halide containing no silver iodide.

In the instance where a seed crystal is used, not less than 20 mol % of silver iodide may be contained in only the seed crystal, which may be thereafter covered with a shell layer. Alternatively, the seed crystal may be made to contain silver iodide in an amount of 0 (zero) or within the range of not more than 10 mol %, and then at least 20 mol % of silver iodide is contained in the inner part of the grain in the step of making the seed crystal to grow, which may be thereafter covered with a shell layer.

In the light-sensitive silver halide photographic material of the present invention, at least 50% of the silver halide grains present in its emulsion layer may preferably be composed of the grain in which the silver iodide has localized as described above.

In another preferred embodiment of the present invention, a monodisperse emulsion having the silver iodide-localized grains as described above is used.

Here, the monodisperse emulsion refers to an emulsion having a variation coefficient of $\sigma/\bar{r} \leqq 0.20$, where $\bar{r}$ is the average grain size of silver halide grains and $\sigma$, the standard deviation thereof.

In the present specification, the average grain size is expressed by the average based on the diameters of grains in the case of spherical silver halide grains, and, in the case of grains with shapes other than the spherical shape, the diameters obtained when a projected area of the grain is calculated into a circle having the same area.

Monodisperse emulsion grains are prepared by double-jet precipitation as in the case of the preparation of regular silver halide grains. Conditions for the double-jet precipitation are the same as those in the method of preparing the regular silver halide grains.

Preparation of a monodisperse emulsion is known in the art, and described, for example, in J. Phot. Sic., 12, 242-251 (1963), Japanese Patent O.P.I. Publications No. 36890/1973, No. 16364/1977, No. 142329/1980 and No. 49938/1983.

In order to obtain the above monodisperse emulsion, it is particularly preferred to use seed crystals and feed silver ions and halide ions to the seed crystals as growth nuclei, thereby making grains to grow.

The broader the grain size distribution of the seed crystals is, the broader the grain size distribution of the grown-up grains also is. Hence, in order to obtain the monodisperse emulsion, it is preferred to use seed crystals with a narrow grain size distribution at the initial stage.

The silver halide grains as described above, used in the light-sensitive silver halide photographic material of the present invention, can be prepared using methods such as the neutral method, the acidic method, the ammoniacal method, the normal precipitation, the reverse precipitation, the double-jet precipitation, the controlled double-jet precipitation, the conversion method and the core/shell method, as described, for example, in the literature such as T. H. James, The Theory of the Photographic Process, Fourth Edition, Macmillan Publishing Co., Inc., (1977), pp. 88-104.

A silver halide emulsion of a surface latent image-forming type can also be prepared by the so-called controlled double-jet precipitation, in which the pH and EAg in a reaction vessel are controlled by gradually increasing the amount of the silver ion solution and halide solution to be added.

A cadmium salt, a palladium salt, a zinc salt, a lead salt, a thallium salt, an iridium salt or a complex salt thereof, a rhodium salt or a complex salt thereof, an iron salt or a complex salt thereof, etc. may also be made present together at the stage of the formation or physical ripening of silver halide grains. The silver halide emulsion of a surface latent image may also be the monodisperse emulsion.

Known photographic additives can be used in the silver halide emulsion of the present invention.

Known photographic additives include, for example, the compounds as described in Research Disclosures RD-17643 (December, 1978) and RD-18716 (Novemeber, 1979), which are as shown in the following table.

| | RD-17643 | | RD-18716 | |
|---|---|---|---|---|
| Additives | Page | Paragraph | Page | Column |
| Chemical sensitizer: | 23 | III | 648 | Upper right |
| Sensitizing dye: | 23 | IV | 648<br>649 | Right to<br>Left |
| Development accelerator: | 29 | XXI | 648 | Upper right |
| Antifoggant: | 24 | VI | 649 | Bottom right |
| Stabilizer: | 24 | VI | 649 | Bottom right |
| UV absorbent: | 25-26 | VIII | 649<br>650 | Right to<br>Left |
| Filter dye: | 25-26 | VIII | 649<br>650 | Right to<br>Left |
| Hardening agent: | 26 | X | 651 | Left |
| Coating aid: | 26-27 | XI | 650 | Right |
| Surfactant: | 26-27 | XI | 650 | Right |
| Plasticizer: | 27 | XII | 650 | Right |
| Lubricant: | 27 | XII | 650 | Right |
| Antistatic agent: | 27 | XII | 650 | Right |

-continued

| Additives | RD-17643 Page | RD-17643 Paragraph | RD-18716 Page | RD-18716 Column |
|---|---|---|---|---|
| Matting agent: | 28 | XVI | 650 | Right |
| Binder: | 26 | IX | 651 | Left |

In the hydrophilic colloid layer of the light-sensitive silver halide photographic material of the present invention, a vinylsulfone compound can preferably be used as a gelatin hardening agent.

The vinylsulfone compound preferably used in the present invention may be any compounds so long as they have at least two vinylsulfonyl groups in the molecule. In particular, the compound that can bring about a greater effect of the present invention includes a compound represented by Formula (H).

$$[CH_2{=}CHSO_2{-}(CH(R))_m]_nZ \qquad \text{Formula (H)}$$

In the formula, R represents a hydrogen atom or a lower alkyl group, and preferably represents a hydrogen atom or a methyl group.

Z represents a linkage group with a valency of n, which may contain at least one of atoms of an oxygen atom, a nitrogen atom and a sulfur atom. The atom contained in Z may preferably be an oxygen atom or a nitrogen atom.

The letter symbol m is 0, 1 or 2, and n is 2 or 3.

Examples of the compound of Formula (H) are shown below.

$CH_2{=}CHSO_2CH_2OCH_2SO_2CH{=}CH_2$ H-1

$CH_2{=}CHSO_2CH_2CH_2CH_2CH_2OCH_2CH_2CH_2CH_2SO_2CH{=}CH_2$ H-2

$CH_2{=}CHSO_2CH_2CH_2OCH_2CH_2OCH_2CH_2SO_2CH{=}CH_2$ H-3

$CH_2{=}CHSO_2CH_2CH_2OCH_2CH_2NHCONHCH_2CH_2OCH_2CH_2SO_2CH{=}CH_2$ H-4

$CH_2{=}CHSO_2CH_2OCH_2CH_2N(CH_3)CH_2CH_2SO_2CH{=}CH_2$ H-5

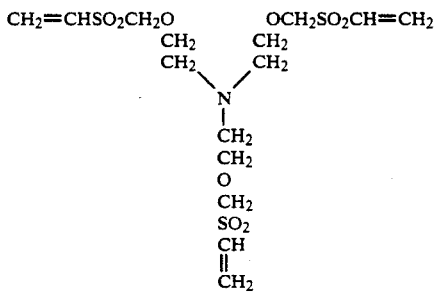

H-6

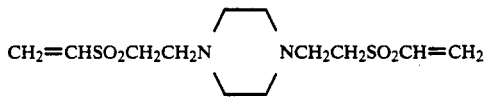

H-7

$CH_2{=}CHSO_2CH_2OCH_2CH_2SO_2CH_2CH_2OCH_2SO_2CH{=}CH_2$ H-8

$CH_2{=}CHSO_2CH_2SO_2CH{=}CH_2$ H-9

$CH_2{=}CHSO_2CH_2CH_2SO_2CH{=}CH_2$ H-10

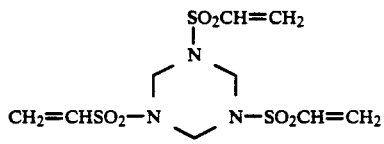

H-11

$CH_2{=}CHSO_2CH_2CH(OH)CH_2CH_2SO_2CH{=}CH_2$ H-12

$CH_2{=}CHSO_2CH_2CONHCH_2CH_2NHCOCH_2SO_2CH{=}CH_2$ H-13

$(CH_2{=}CHSO_2CH_2CH_2O{-}CH_2CH_2)_2SO_2$ H-14

$[(CH_2{=}CHSO_2CH_2)_3CCH_2SO_2CH_2CH_2]_2N{-}CH_2CH_2SO_3K$ H-15

-continued
H-16
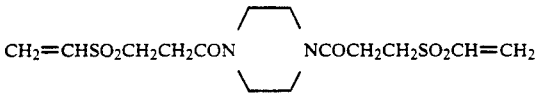
H-17
$(CH_2{=}CHSO_2CH_2)_2C(CH_2SO_2CH_2CH_2OSO_3Na)_2$
H-18
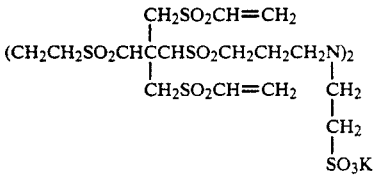
H-19
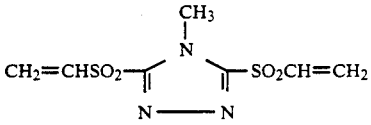
H-20
$(CH_2{=}CHSO_2CH_2)_4C$
H-21
$CO(CH_2CH_2SO_2CH{=}CH_2)_2$
H-22
$NH(CH_2CH_2SO_2CH{=}CH_2)_2$
H-23
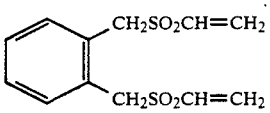
H-24
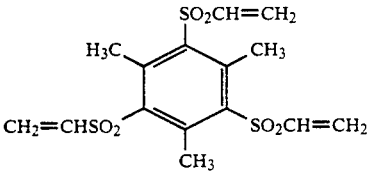
H-25
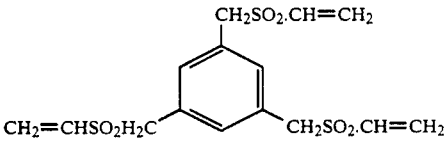
H-26
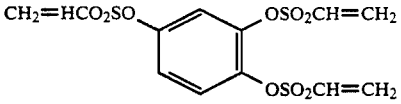
H-27
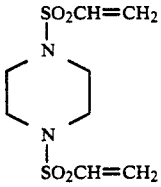
H-28
$CH_3C(CH_2OCH_2SO_2CH{=}CH_2)_3$
H-29
$N(CH_2CH_2OCH_2SO_2CH{=}CH_2)_3$
H-30
$H_{17}C_8{-}C(CH_2SO_2CH{=}CH_2)_3$
H-31
$CH_2{=}CHSO_2CH_2CH(SO_2CH{=}CH_2)CH_2SO_2CH{=}CH_2$
H-32
$BrH_2C{-}C(CH_2SO_2CH{=}CH_2)_3$ -continued $(CH_2{=}CHSO_2CH_2)_2CH{-}CH(CH_2SO_2CH{=}CH_2)_2$ H-33

$(CH_2{=}CHSO_2CH_2)_3C{-}CH_2OCH_2C(CH_2SO_2CH{=}CH_2)_3$ H-34

$(CH_2{=}CHSO_2CH_2)_3C{-}CH_2SO_2CH_2CH_2Cl$ H-35

H-36

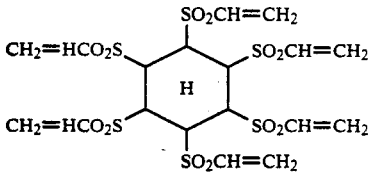

H-37

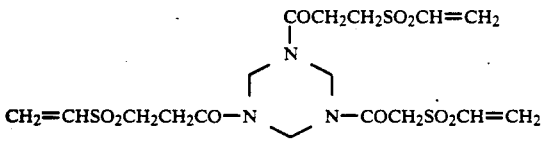

$CH_2{=}CHSO_2(CH_2)_4SO_2CH{=}CH_2$ H-38

Preferred vinylsulfone-type hardening agents used in the present invention include, for example, aromatic compounds as disclosed in West German Patent No. 1,100,942, alkyl compounds combined with hetero atoms as disclosed in Japanese Examined Patent Publications No. 29622/1969 and No. 25373/1972, sulfonamides or ester compounds as disclosed in Japanese Examined Patent Publication No. 8736/1972, 1,3,5-tris[β-(vinylsulfonyl)propionyl]-hexahydro-s-triazine as disclosed in Japanese Patent O.P.I. Publication No. 24435/1974, and alkyl compounds as disclosed in Japanese Patent O.P.I. Publicaton No. 44164/1976.

In addition to the above exemplary compounds, the vinylsulfone-type hardening agent that can be used in the present invention also includes a reaction product obtained by reacting a compound having at least three vinylsulfonyl groups, with a compound having a group capable of reacting with the vinylsulfonyl groups and a water-soluble group as exemplified by diethanolamine, thioglycolic acid, surcosine sodium salt, and taurine sodium salt.

In the light-sensitive silver halide photographic material according to the present invention, a dye can be used in a layer which is lower to the emulsion layer of the present invention and contiguous to the support, for the purpose of decreasing so-called cross-over effect, and a dye can also be added in a protective layer and/or the emulsion layer of the present invention for the purpose of improving the sharpness of an image or decreasing the fog caused by safelight. Then, all sorts of known dyes used for the above purposes can be used as the above dye.

The support used for the silver halide photographic emulsion of the present invention includes all of known supports, as exemplified by films of polyesters such as polyethylene terephthalate, polyamide films, polycarbonate films, styrene films, baryta paper, and papers coated with synthetic polymers. The emulsion of the present invention may be coated on one side or both sides of the support. In the instance where it is coated on both sides, it may be so coated that the constitution of emulsion layers is symmetric or asymmertric.

The light-sensitive silver halide photographic material according to the present invention can be subjected to development processing by known methods usually used. As developing solutions, the developing solutions usually used can be used, as exemplified by those containing hydroquinone, 1-phenyl-3-pyrazolidone, N-methyl-p-aminophenol or p-phenylenediamine, which can be used alone or in combination of two or more. As other additives for developing solution, those conventionally used can be used.

A developing solution containing an aldehyde hardening agent can also be used in the light-sensitive silver halide photographic material according to the present invention. For example, it is possible to use developing solutions containing dialdehydes such as maleic dialdehyde, or glutaraldehyde, and sodium bisulfite salts of these, which are known in the photographic field.

The total processing time according to the present invention refers to the time through which the light-sensitive material of the present invention is inserted to first rollers, which constitute the inlet of an automatic processor to which the light-sensitive material is inserted, and thereafter it passes through a developing tank, a fixing tank, and a washing tank until it reaches the last roller at a drying section outlet.

The total processing time is 60 seconds or less, and preferably from 20 to 60 seconds. A processing time of less than 20 seconds may give rise to insufficient sensitivity, or bring about a dye residue, or a non-uniform image.

The processing is carried out at a temperature of 60° C. or less, and preferably from 20° to 45° C.

An example of particulars of the total processing time is shown below.

| Processing steps | Processing temperature (°C.) | Precessing time (sec.) |
|---|---|---|
| Inserting | — | 1.2 |
| Developing + cross-over | 35 | 14.6 |
| Fixing + cross-over | 33 | 8.2 |
| Washing + cross-over | 25 | 7.2 |
| Sqeegeeing | 40 | 5.7 |
| Drying | 45 | 8.1 |
| Total: | — | 45.0 |

EXAMPLES

The present invention will be described below in greater detail by giving Examples. The present invention, however, is by no means limited to these.

EXAMPLE 1

While conditions were controlled to be 60° C., pAg=8 and pH=2.0, a monodisperse emulsion (A) of cubic silver iodobromide, having an average grain size of 0.15 μm and containing 2.0 mol % of silver iodide, were obtained by the double-jet precipitation. Observation on an electron microscope photograph revealed that twinned grains were produced at a rate of not more than 1% in terms of number. Using this emulsion (A) as a seed emulsion, grains were made to grow in the following manner.

Namely, the seed crystals (A) were dispersed in 8.5 l of a solution kept at 40° C. and containing a protective-colloidal gelatin and optionally ammonia, and then the pH of the resulting dispersion was adjusted with acetic acid.

Using the resulting solution as a mother liquor, an aqueous ammoniacal silver ion solution and a aqueous mixed solution of potassium bromide and potassium iodide, of 3.2N each, were added by the double-jet method while the pAg and the pH were controlled to be 7.3 and 9.7, respectively. A layer of silver halide with a silver iodide content of 35 mol % was thus formed over the seed seed crystals.

Next, an aqueous silver nitrate solution and an aqueous potassium bromide solution were added while the pH and the pAg were controlled to be 6.3 and 7.7, respectively. Emulsion A was thus obtained.

The area ratio of (100) face to (111) face was measured by the Kubelka-Munk's method to reveal that it was 96/4.

Next, with a change of the pAg value to 7.85 in the reaction vessel, Emulsion B was prepared in the same manner as Emulsion A. As a result of measurement by the Kubelka-Munk's method, the area ratio of (100) face to (111) face was 92/8.

With a change of the pAg value to 8.0, Emulsion C was similarly prepared.

The face ratio of the resulting emulsion was 88/12.

Similarly, with a change of the pAg to 8.05, Emulsion D was prepared. The face ratio of the resulting emulsion was 84/16.

Similarly, with a change of the pAg to 8.3, Emulsion E was prepared. The face ratio of the resulting emulsion was 66/34. With a change of the pAg to 8.95 in the reaction vessel, Emulsion F was further prepared. The face ratio of the resulting emulsion was 15/85.

By a method similar to the above, a layer of silver halide with a silver iodide content of 35 mol % was formed, and thereafter a cyanorhodium salt was added in an amount of 16 μmol of rhodium per mol of silver. Then, an aqueous silver nitrate solution and an aqueous potassium bromide solution were added while the pH and the pAg were controlled to be 6.3 and 7.7, respectively. Emulsion G was thus obtained. The area ratio of (100) face to (111) face was measured by the Kubelka-Munk's method to reveal that it was 96/4.

Grain size of these emulsions was measured by centrifugal precipitation to reveal that it was 0.45 μm on the average.

To these seven kinds of emulsions, sodium thiosulfate, ammonium thiocyanate and chloroauric acid were added to effect chemical sensitization at 60° C. to an optimum.

Subsequently, the compounds represented by Formula (I) according to the present invention and comparative compounds were each added as shown in Table 1, and 4-hydroxy-6-methyl-1,3,3a,7-tetrazaindene was also added in an appropriate amount to effect stabilization of the emulsions.

Separately, supports were prepared in the following way: To provide a backing layer, a backing layer coating solution comprising 400 g of gelatin, 2 g of polymethyl methacrylate, 6 g of sodium dodecylbenzenesulfonate, 20 g of the following anti-halation dye, and glyoxal was prepared, and coated on one side of a polyethylene terephthalate base coated with a subbing solution comprising an aqueous copolymer dispersion obtained by diluting to a concentration of 10 wt. % a copolymer composed of three kinds of monomers of 50 wt. % of glycidyl methacrylate, 10 wt. % of methyl acrylate and 40 wt. % of butyl methacrylate, together with a protective layer solution comprising gelatin, a matting agent, glyoxal and sodium dodecylbenzenesulfonate. A back-coated support was thus obtained.

The coating weights in the backing layer and the protective layer are 2.5 g/m$^2$ and 2.0 g/m$^2$, respectively, in terms of gelatin coating weight.

ANTI-HALATION DYE

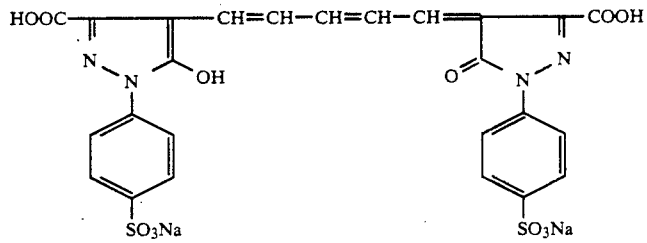

PREPARATION OF COATED SAMPLES

As additives for the emulsion layer, following compounds were added in amounts per mol of silver halide.

| | |
|---|---|
| Diethylene glycol | 10 g |
| Nitrophenyl-triphenylphosphonium chloride | 50 mg |
| Ammonium 1,3-dihydroxybenzene-4-sulfonate | 1 g |
| Sodium 2-mercaptobenzimidazole-5-sulfonate | 10 mg |
| Polyacrylamide (average molecular weight: 40,000) | 10 g |

-continued

| | |
|---|---|
| 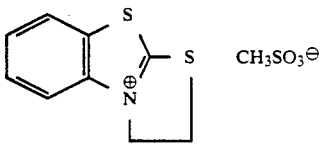 | 35 mg |
| 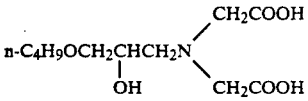 | 1 g |
| 1,1-dimethylol-1-bromo-1-nitromethane | 10 mg |
| 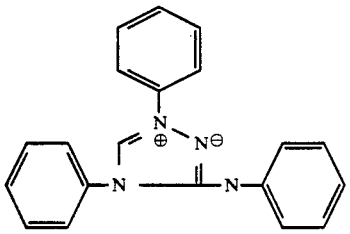 | 100 mg |

As additives for the protective layer, the following compounds were added in amounts per gram of gelatin.

| | |
|---|---|
| $CH_2COO(CH_2)_9CH_3$ / $CHCOO(CH_2)_2CH(CH_3)_2$ / $SO_3Na$ | 20 mg |
| Matting agent comprising silica with an average particle diameter of 7 μm | 7 mg |
| Colloidal silica with an average particle diameter of 0.013 μm | 70 mg |

The exemplary compounds of the fluorine-containing surface active agent according to the present invention and comparative compounds were further added as shown in Table 1, and as a hardening agent $$CH_2{=}CHSO_2{-}CH_2OCH_2{-}SO_2CH{=}CH_2$$

was added in an appropriate amount.

On the back-coated base as previously described, the respective layers were provided by slide hopper coating in the manner that the silver halide emulsion layer and the protective layer, in this order from the support, were both simultaneously formed in layers at a coating speed of 60 m/min. Samples were thus obtained. Coating weight of silver was 2.9 g/m$^2$, and the coating weight of gelatin was 3 g/m$^2$ on the emulsion layer and 1.3 g/m$^2$ on the protective layer.

These samples were stored for 3 days under conditions of 23° C. and 55% RH, and thereafter exposed to light using an He-Ne laser beam, with variations in the amount of light at intervals of 1/100,000 second per one picture element (100 μm$^2$). Thereafter, the resulting samples were processed with a developing solution and a fixing solution (each having the composition shown below), using an automatic processor SRX-501 (manufactured by Konica Corporation), in two modes of time so as for the total processing time to be 90 seconds and 45 seconds, respectively.

To examine processing uniformity, 8×10 inch size samples were subjected to overall exposure in the same amount of light, followed by the same processing as the above.

Sensitivity, gradation (density: 1.0 to 2.0), tone of developed silver, maximum density, and processing uniformity were evaluated on each sample after processing. The sensitivity is indicated as a relative value, assuming as 100 the value of Sample 6 for the amount of exposure required for giving the density of fog +1.0.

Results obtained are shown in Table 1.

Composition of developing solution and fixing solution:

| Developing Solution 1: | |
|---|---|
| Potassium sulfite | 55.0 g |
| Hydroquinone | 25.0 g |
| 1-Phenyl-3-pyrazolidone | 1.2 g |
| Boric acid | 10.0 g |
| Sodium hydroxide | 21.0 g |
| Triethylene glycol | 17.5 g |
| 5-Nitrobenzimidazole | 0.10 g |
| Glutaldehyde metabisulfite | 15.0 g |
| Glacial acetic acid | 16.0 g |
| Potassium bromide | 4.0 g |
| Triethylenetetraminehexaacetic acid | 2.5 g |
| Made up to 1 liter by adding water. | |

| Fixing Solution 1: | |
|---|---|
| Ammonium thiosulfate | 130.9 g |
| Anhydrous sodium sulfite | 7.3 g |
| Boric acid | 7.0 g |
| Acetic acid (90 wt. % solution) | 5.5 g |
| Disodium ethylenediaminetetraacetic acid | 3.0 g |
| Sodium acetate trihydrate | 25.8 g |
| Aluminum sulfate octadecahydrate | 14.6 g |
| Sulfuric acid (50 wt. % solution) | 6.77 g |
| Made up to 1 liter by adding water. | |

Comparative (Cp) surface active agents:

Cp-A

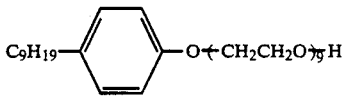

Cp-B

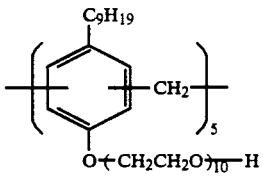

Cp-C

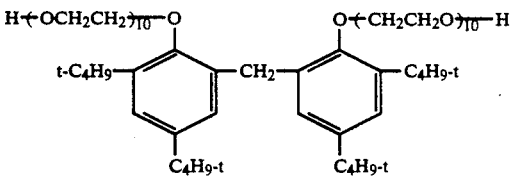

Comparative Sensitizing dye:

Comparative Dye: Cp-1

-continued

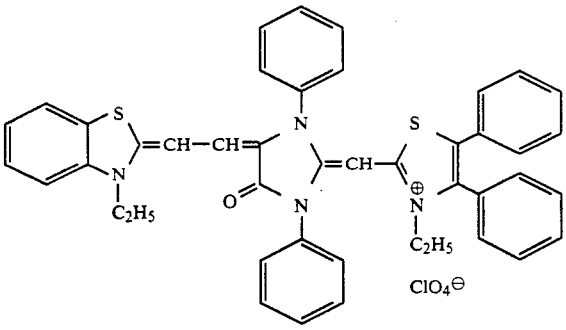

Comparative Dye: Cp-2

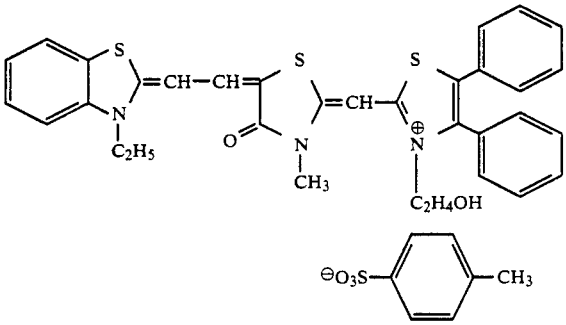

tion, and maximum density. The use of the fluorine-containing surface active agent has brought about good processing uniformity and good photographic performance.

EXAMPLE 2

The same samples as those obtained in Example 1 were exposed to light in the same manner as in Example 1, and processed with the following processing solutions, using an automatic processor SRX-501 (manufactured by Konica Corporation) so as for the total processing time to be 45 seconds.

| (Composition of developing solution) | |
|---|---|
| Potassium hydroxide | 24 g |
| Sodium sulfite | 40 g |
| Potassium sulfite | 50 g |
| Diethylenetriaminepentaacetic acid | 2.4 g |
| Boric acid | 10 g |
| Hydroquinone | 35 g |
| Diethylene glycol | 11.2 g |
| 4-Hydroxymethyl-4-methyl-1-phenyl-3-pyrazolidone | 1.0 g |
| 5-Methylbenzotriazole | 0.06 g |
| Potassium bromide | 2 g |
| 1-Phenyl-3-pyrazolidone | 0.5 g |
| Made up to 1 liter using water, and adjusted to pH 10.5. | |

| (Composition of fixing solution) | |
|---|---|
| Ammonium thiosulfate | 140 g |
| Sodium sulfite | 15 g |
| Disodium ethylenediaminetetraacetic acid dihydrate | 0.025 g |
| Sodium hydroxide | 6 g |

TABLE 1

| | | | | | Sensitizing dye | | 35° C., 90 sec Processing | | | | | 35° C., 45 sec Processing | | | | | |
|---|---|---|---|---|---|---|---|---|---|---|---|---|---|---|---|---|---|
| No. | Em | Face ratio (100)/(111) | Surfactant | A-mount (mg/m²) | | A-mount (mg/AgX) | (1) S | Gra-da-tion | Max. den-si-ty | (2) | (3) | (1) S | Gra-da-tion | Max. den-si-ty | (2) | (3) | (4) |
| 1 | F | 15/85 | F-32 | 10 | Ex (18) | 80 | 101 | 1.7 | 2.9 | 3 | 4 | 100 | 2.3 | 2.6 | 2 | 1 | X |
| 2 | F | 15/85 | F-32 | 10 | Ex (15) | 80 | 105 | 1.6 | 3.0 | 3 | 4 | 102 | 2.2 | 2.7 | 2 | 1 | X |
| 3 | E | 66/34 | F-32 | 10 | Ex (15) | 80 | 105 | 1.6 | 3.0 | 3 | 4 | 103 | 2.3 | 2.7 | 2 | 2 | X |
| 4 | D | 84/16 | F-32 | 10 | Cp-1 | 80 | 20 | 1.5 | 2.9 | 3 | 4 | 18 | 1.9 | 2.9 | 2 | 2 | X |
| 5 | D | 84/16 | F-32 | 10 | Cp-2 | 80 | 35 | 1.4 | 2.9 | 3 | 4 | 32 | 1.9 | 2.9 | 2 | 2 | X |
| 6 | D | 84/16 | Cp-A | 10 | Ex (15) | 80 | 100 | 1.9 | 3.1 | 4 | 3 | 100 | 2.3 | 3.0 | 4 | 3 | X |
| 7 | D | 84/16 | Cp-B | 10 | Ex (8) | 80 | 100 | 1.7 | 3.2 | 4 | 3 | 98 | 2.4 | 3.1 | 4 | 3 | X |
| 8 | D | 84/16 | F-29 | 10 | Ex (8) | 80 | 108 | 1.8 | 3.3 | 4 | 5 | 107 | 1.9 | 3.2 | 4 | 5 | Y |
| 9 | D | 84/16 | F-3 | 10 | Ex (9) | 80 | 108 | 1.8 | 3.3 | 4 | 5 | 107 | 1.9 | 3.2 | 4 | 5 | Y |
| 10 | D | 84/16 | F-5 | 10 | Ex (9) | 80 | 108 | 1.8 | 3.3 | 4 | 5 | 107 | 1.9 | 3.2 | 4 | 5 | Y |
| 11 | D | 84/16 | F-11 | 10 | Ex (19) | 80 | 108 | 1.8 | 3.3 | 4 | 5 | 107 | 1.9 | 3.2 | 4 | 5 | Y |
| 12 | D | 84/16 | F-14 | 10 | Ex (22) | 80 | 108 | 1.8 | 3.3 | 4 | 5 | 107 | 1.9 | 3.2 | 4 | 5 | Y |
| 13 | D | 84/16 | F-17 | 10 | Ex (6) | 80 | 95 | 1.7 | 3.3 | 3 | 4 | 94 | 1.9 | 3.2 | 3 | 4 | Y |
| 14 | D | 84/16 | F-20 | 10 | Ex (26) | 80 | 95 | 1.7 | 3.3 | 3 | 4 | 94 | 1.9 | 3.2 | 3 | 4 | Y |
| 15 | D | 84/16 | F-20 | 10 | Ex (7) | 80 | 95 | 1.7 | 3.3 | 3 | 4 | 94 | 1.9 | 3.2 | 3 | 4 | Y |
| 16 | D | 84/16 | F-27 | 10 | Ex (7) | 80 | 96 | 1.7 | 3.2 | 3 | 4 | 95 | 1.8 | 3.1 | 3 | 4 | Y |
| 17 | D | 84/16 | F-27 | 10 | Ex (8) | 80 | 103 | 1.9 | 3.2 | 4 | 4 | 102 | 1.9 | 3.2 | 4 | 4 | Y |
| 18 | D | 84/16 | F-27 | 10 | Ex (24) | 80 | 103 | 1.6 | 3.1 | 4 | 4 | 103 | 1.6 | 3.1 | 4 | 4 | Y |
| 19 | C | 88/12 | F-36 | 5 | Ex (24) | 80 | 103 | 1.7 | 3.2 | 4 | 4 | 103 | 1.8 | 3.2 | 4 | 4 | Y |
| 20 | C | 88/12 | F-36 | 10 | Ex (24) | 80 | 105 | 1.9 | 3.0 | 5 | 4 | 105 | 2.0 | 3.0 | 5 | 4 | Y |
| 21 | C | 88/12 | F-28 | 10 | Ex (18) | 40 | 88 | 1.6 | 2.9 | 5 | 4 | 85 | 1.6 | 2.9 | 5 | 4 | Y |
| 22 | C | 88/12 | F-28 | 10 | Ex (18) | 80 | 102 | 1.9 | 3.0 | 5 | 4 | 101 | 1.9 | 3.1 | 5 | 4 | Y |
| 23 | C | 88/12 | F-28 | 10 | Ex (18) | 200 | 135 | 2.0 | 3.2 | 3 | 4 | 133 | 2.0 | 3.2 | 3 | 4 | Y |
| 24 | B | 92/8 | F-28 | 10 | Ex (18) | 80 | 101 | 1.8 | 3.2 | 5 | 5 | 101 | 1.9 | 3.2 | 5 | 5 | Y |
| 25 | B | 92/8 | Cp-B | 10 | Ex (8) | 80 | 106 | 1.8 | 3.3 | 3 | 2 | 106 | 1.9 | 3.2 | 2 | 2 | X |
| 26 | B | 92/8 | Cp-C | 10 | Ex (8) | 80 | 102 | 1.9 | 3.2 | 3 | 2 | 102 | 2.0 | 3.2 | 2 | 2 | X |
| 27 | A | 96/4 | F-32 | 10 | Ex (21) | 80 | 110 | 1.7 | 3.1 | 4 | 5 | 123 | 2.1 | 3.1 | 4 | 5 | Y |
| 28 | A | 96/4 | F-32 | 10 | Ex (5) | 80 | 125 | 2.0 | 3.2 | 5 | 5 | 110 | 1.7 | 3.2 | 5 | 5 | Y |
| 29 | A | 96/4 | F-29 | 10 | Ex (5) | 80 | 123 | 1.9 | 3.1 | 5 | 5 | 124 | 1.9 | 3.1 | 5 | 5 | Y |
| 30 | G | 96/4 | F-29 | 10 | Ex (5) | 80 | 128 | 1.9 | 3.2 | 5 | 5 | 128 | 1.9 | 3.1 | 5 | 5 | Y |

(1): Sensitivity
(2): Tone; 5: Very good, 4: Good, 3: Ordinary, 2: Poor, 1: Very poor
(3): Processing uniformity; 5: Very good, 4: Good, 3: Ordinary, 2: Poor, 1: Very poor
(4): Remarks; X: Comparative Example, Y: Present Invention As will be evident from Table 1, the samples according to the present invention each show a good tone and at the same time are superior in all the sensitivity, grada- -continued

| (Composition of fixing solution) |
|---|
| Made up to 1 liter using water, and adjusted to pH 5.10 with acetic acid. |

Sensitivity, gradation (density: 1.0 to 2.0), tone of developed silver, maximum density, and processing uniformity were evaluated in the same manner as in Example 1 on each sample after processing.

Results obtained are shown in Table 2.

TABLE 2

| | | | Surfactant | | Sensitizing dye | | 35° C., 45 sec Processing | | | | | |
|---|---|---|---|---|---|---|---|---|---|---|---|---|
| No. | Em | Face ratio (100)/(111) | | Amount (mg/m²) | | Amount (mg/AgX) | Sensitivity S | Gradation | Maximum density | Tone | Processing uniformity | Remarks |
| 1 | F | 15/85 | F-32 | 10 | Ex (15) | 80 | 101 | 2.3 | 2.6 | 2 | 1 | X |
| 4 | D | 84/16 | F-32 | 10 | Cp-1 | 80 | 18 | 1.9 | 2.9 | 2 | 2 | X |
| 6 | D | 84/16 | Cp-A | 10 | Ex (15) | 80 | 110 | 2.3 | 3.0 | 4 | 3 | X |
| 10 | D | 84/16 | F-5 | 10 | Ex (9) | 80 | 118 | 1.9 | 3.2 | 4 | 5 | Y |
| 16 | D | 84/16 | F-27 | 10 | Ex (7) | 80 | 110 | 1.8 | 3.1 | 3 | 4 | Y |
| 20 | C | 88/12 | F-36 | 10 | Ex (24) | 80 | 116 | 2.0 | 3.0 | 5 | 4 | Y |
| 22 | C | 88/12 | F-28 | 10 | Ex (18) | 80 | 111 | 1.9 | 3.1 | 5 | 4 | Y |
| 25 | B | 92/8 | Cp-B | 10 | Ex (8) | 80 | 112 | 1.9 | 3.2 | 4 | 4 | X |
| 29 | A | 96/4 | F-29 | 10 | Ex (5) | 80 | 133 | 1.9 | 3.1 | 5 | 5 | Y |
| 30 | G | 96/4 | F-29 | 10 | Ex (5) | 80 | 138 | 1.9 | 3.1 | 5 | 5 | Y |

X: Comparative Example,
Y: Present Invention

As will be evident from Table 2, the samples according to the present invention are seen to show the same effect as in Example 1, in particular, a superior effect in respect of the sensitivity, as a result of the processing with the developing solution and fixing solution having the above composition.

As having been described in the above, the present invention has provided an image forming method for a light-sensitive silver halide photographic material, which can remarkably suppress the processing non-uniformity from occurring.

From the viewpoint of photographic performance, the present invention has also made it possible to obtain a silver image with superior maximum density and tone.

What is claimed is:

1. An image forming method comprising the steps of subjecting to imagewise exposure a light-sensitive silver halide photographic material which comprises a support and a silver halide emulsion layer provided on said support, wherein said silver halide emulsion layer contains a silver halide grain having an area ratio of (100) face to (111) face of not less than 5 and being spectrally sensitized with a sensitizing dye represented by the following Formula (I); and at least one layer including in said light-sensitive silver halide photographic material contains a fluorine-containing surface active agent; and processing said exposed light-sensitive silver halide photographic material with processes comprising developing with a developing solution, for a period of time of from 20 seconds to 60 seconds in total

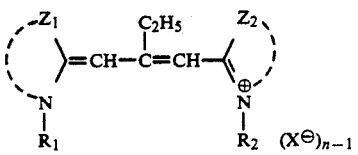

Formula (I)

wherein $Z_1$ and $Z_2$ each represent a group of non-metallic atoms necessary to complete a benzothiazole nucleus, benzoselenazole nucleus, naphthothiazole nucleus or naphthoselenazole nucleus that may have a substituent; $R_1$ and $R_2$ each represent a lower alkyl group of up to 4 carbon atoms, a substituted lower alkyl group of up to 4 carbon atoms; $X^{\ominus}$ represents an anion; and n represents an integer of 1 or 2, provided that n is 1 when an intramolecular salt is formed.

2. A method according to claim 1, wherein said silver halide grain has an area ratio of (100) face to (111) face of not less than 10.

3. A method according to claim 1, wherein said silver halide grain contains silver iodide.

4. A method according to claim 2, wherein said silver halide grain has a silver iodide-localized part inside the grain.

5. A method according to claim 4, wherein the silver iodide content of said silver iodide-localized part is from 30 to 40 mol %.

6. A method according to claim 1, wherein said silver halide emulsion layer contains a monodisperse silver halide emulsion, having a variation coefficient of not more than 0.20.

7. A method according to claim 1, wherein said silver halide grain contains a metal ion selected from zinc, cadmium, lead, thallium, iron, palladium, iridium, and rhodium.

8. A method according to claim 1, wherein said surface active agent has a structure containing a fluorine-containing alkyl group having at least 4 carbon atoms.

9. A method according to claim 1, wherein said surface active agent is contained in a protective layer, a silver halide emulsion layer, or a backing layer of said light-sensitive silver halide photographic material.

10. A method according to claim 1, wherein said imagewise exposed light-sensitive silver halide photographic material is processed by steps of developing, fixing, washing and drying with an automatic processor for a period of time of from 20 seconds to 60 seconds.

11. The method of claim 1 wherein the sensitizing dye is present in an amount of 0.005 to 1 gram per mole of silver halide and is selected from the group consisting of the following dyes:

(1)
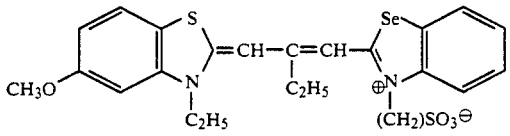
(2)
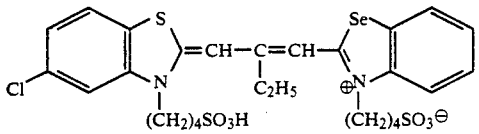
(3)
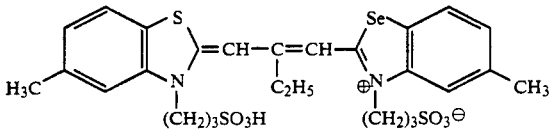
(4)
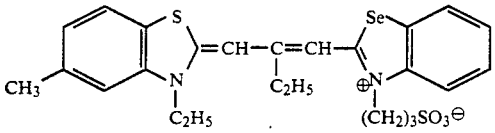
(5)
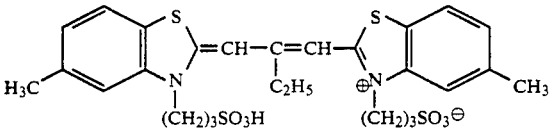
(6)
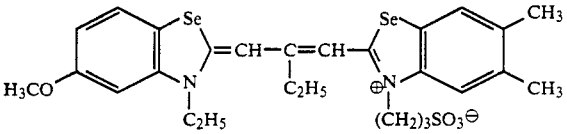
(7)
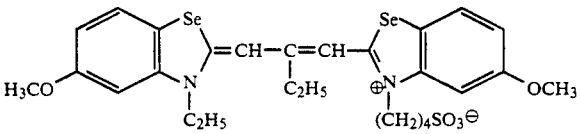
(8)
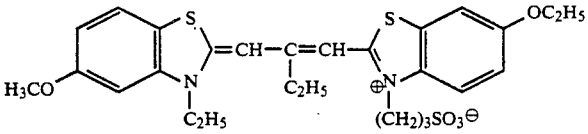
(9)
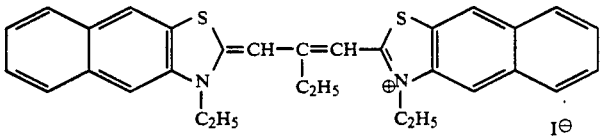
(10)
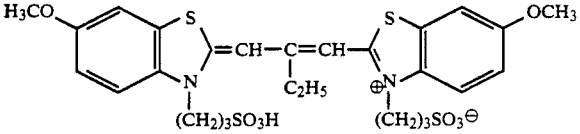

-continued
(11)
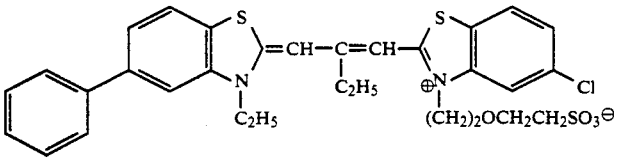
(12)
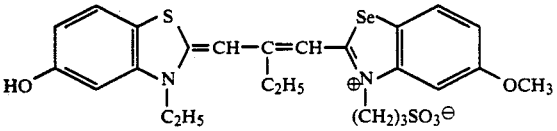
(13)
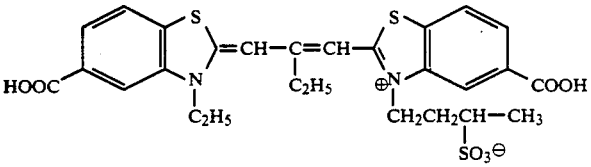
(14)
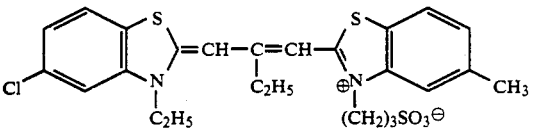
(15)
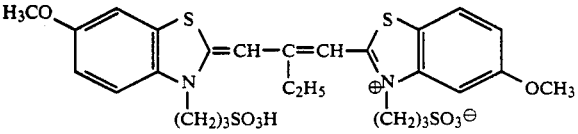
(16)
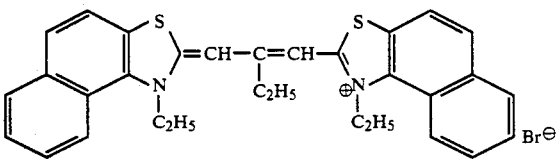
(17)
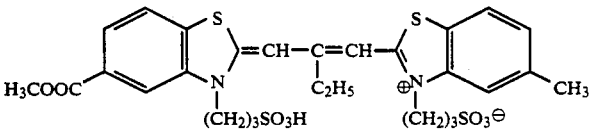
(18)
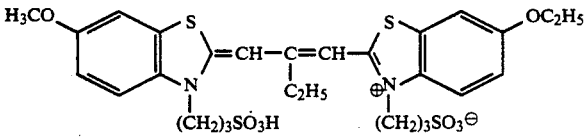
(19)
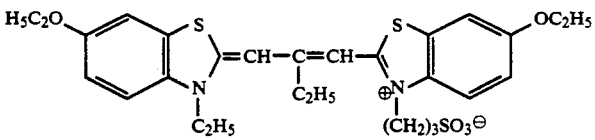
(20)
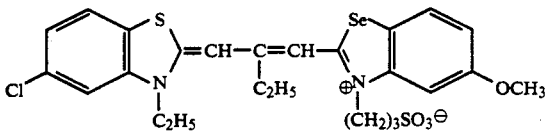

-continued
(21)
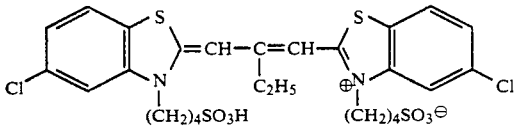
(22)
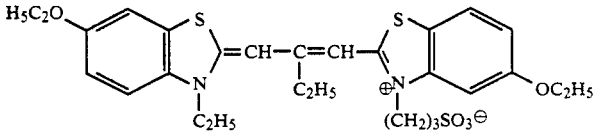
(23)
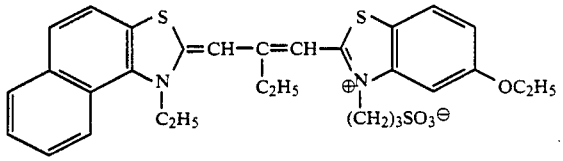
(24)
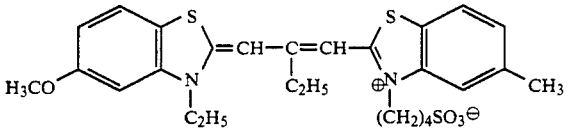
(25)
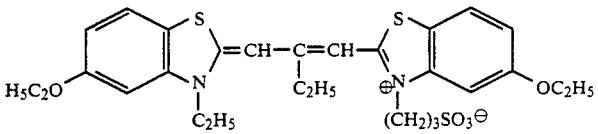
(26)
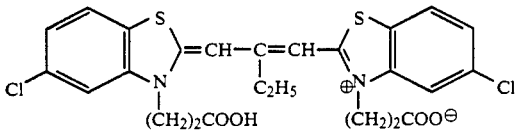
(27)
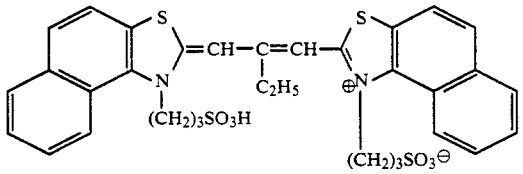
(28)
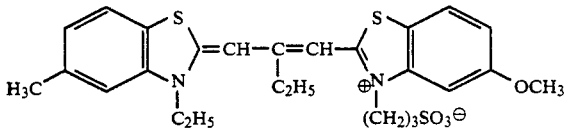
(29)
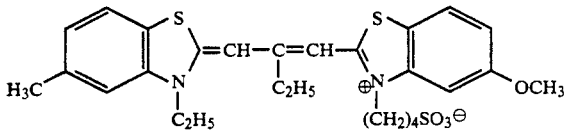
(30)
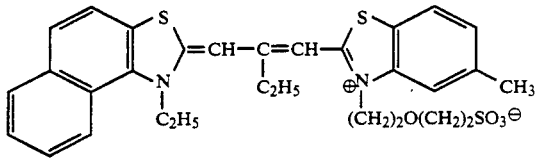

-continued
(31)
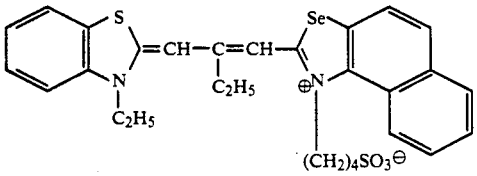
(32)
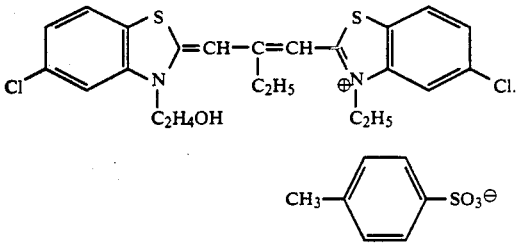
* * * * *